US005116061A

United States Patent [19]

Zentner, Jr.

[11] Patent Number: 5,116,061

[45] Date of Patent: May 26, 1992

[54] GAME USING BEADS STACKED ON PINS

[76] Inventor: John R. Zentner, Jr., 22442 Bessemer St., Canoga Park, Calif. 91367

[21] Appl. No.: 702,189

[22] Filed: May 20, 1991

[51] Int. Cl.[5] ..... A63F 3/00

[52] U.S. Cl. ..... 273/241; 273/271; 273/280; 273/290

[58] Field of Search ..... 273/241, 271, 280, 290

[56] References Cited

U.S. PATENT DOCUMENTS 2,100,280 11/1937 Goldberger ..... 273/280

4,977,941 12/1990 Henderson ..... 273/148 R

FOREIGN PATENT DOCUMENTS 2110097 6/1983 United Kingdom ..... 273/271

OTHER PUBLICATIONS

Gamesview: Sogo, Games and Puzzles Magazine, Mar. 1978, pp. 26-27.

*Primary Examiner*—Benjamin Layno

*Attorney, Agent, or Firm*—Albert O. Cota

[57] ABSTRACT

A strategy game which has as structural base (20) upon which a concentric pedestal (26) is rotatably mounted permitting players to revolve for viewing. A number of equal spacial pins (32) project upwardly around the periphery of the pedestal and each of the two players alternately place their own marked hollow beads (36) over the pins. The pedestal is preferably round to allow a game to be played that has a playing field that is free from limiting boundaries, sidelines or barriers. The game is won when a player aligns four beads in a row either horizontal, diagonal or vertical. A storage bag (40) with a drawstring (42) encloses the pedestal beads and base for protection when not in use.

8 Claims, 2 Drawing Sheets

GAME USING BEADS STACKED ON PINS

TECHNICAL FIELD

The present invention relates to strategy games for two players in general, more specifically to a game using a rotatable circular platform with upright pins and hollow beads placed on the pins.

BACKGROUND ART

Previously many types of games have been developed and are in use for two players using the principle of placing objects on a board or similar structure with the purpose of aligning a series of objects in a row. As an example, checkers is played on a board having alternately dark and light colors using opposed sets of pieces and has enjoyed popularity for centuries. Other games such as so called three dimensional tic-tack-toe employ the same basic principle except using a series of stacked transparent board achieving an alignment of pieces in the third dimension. Prior art is replete with structure using similar principles, however, these prior-art games such as "CONNECT FOUR" a trademarked game manufactured by Milton Bradley Inc. of Massachusetts, have limiting boundaries and sidelines which limit the flexibility, power and strategy levels of the game.

| U.S. Pat. No. | INVENTOR | ISSUED |
|---|---|---|
| 2,485,143 | Duncan | 18 October 1949 |
| 3,556,526 | Currie | 19 January 1971 |
| 3,561,774 | Brinser | 9 February 1971 |
| 4,119,320 | Chorba et al | 10 October 1978 |
| 4,239,230 | Shoptaugh | 16 December 1980 |
| 4,979,748 | Danielak et al | 25 December 1990 |

Duncan teaches a three dimensional tick-tack-toe game with pawns having a socket on the top and a stem on the bottom. The game is played with a square board having nine holes and opposing pawns are placed one on top of the other until, three in a row are aligned.

Currie uses a board with eight upstanding pins with rings for tokens, each opponent set having opposite magnetic poles thus positioning the tokens in a interspadial array on the poles. The object is to align three like tokens.

Brinser similarly uses a board in which nine support members are uprightly mounted. The support members are, however, three different diameters and the playing pieces are also in sets of three diameters each complementary with the other. The object is the same as previously discussed except smaller pieces may be covered by larger pieces during the course of the game.

Chorba et al teach a game with a triangular board and nine elongated pegs placed in rows of three discrete groupings. The playing pieces have a hole allowing accommodation by the pegs. A wild piece having a separate color is used in play and the three dimensional alignment is used as the object of play.

Shoptaugh uses a board with two step holes and three separate types of playing pieces. Two types are played simultaneously independent of the other playing fields. The third type blocks the play and the game is undertaken using the interplay between the blocking and non-blocking pieces.

Danielak et al discloses a token aligning three-dimensional strategy game using five aligned tubes with an opaque upper portion and a transparent lower portion. Tokens are alternately placed in the tubes and a pin is pulled dropping the balls into the transparent section. The object is to align the hidden tokens in a row.

It is clearly seen that the use of tokens or playing pieces placed alternately over pins or pegs to achieve three dimensional alignment is well known in the art however, the orientation of the pins on the board and its rotational ability without limiting boundaries appear to be completely lacking in the prior art thus described.

DISCLOSURE OF THE INVENTION

The field of recreational games to competitively match suits with one anther along with the element of chance has always been intriguing particularly when the game is complicated enough to require strategy and thought to maneuver the opponent into a situation where two moves may be made to win the game and the opponent can only block one. Further moves, or dropping beads on the pins may be planned well in advance requiring thought and tactical stratagem.

A primary object of the invention is to provide a game configured as a rotating game table that has no limiting game boundaries, sidelines or barriers which, in turn, allows a wide assortment of game strategies to be planned and effected.

Another primary object of the invention is to keep the rules and mechanisms simple enough to learn easily so as not to be discouraging and yet be able to be challenging during the period of play.

An important object along with the simple rules is directed toward the ability of all ages to learn the game quickly making the initial challenge not mastering the rules but the strategies and tactics required in order to win the game.

Another object of the game is to have a rotatable surface enabling the player to visualize all of the possible moves and yet control the situation when advantageous by simply rotating the pedestal to concentrate on a specific area also requiring the opponent to pay attention to the action taking place so as to be prepared for the next move within a given length of time.

Still another object of the invention basically eliminates arbitrary judgments and controversial decisions while playing the game, as the rules are simple, concise and when a bead is dropped the move is irrevocably made. Time constraints are also easily understood and the placement of the beads in the required row is decisive and unmistakable.

Yet another object of the invention is simplicity to fabricate the apparatus and yet it has eye appealing symmetrical artistic qualities as the base and board may be made of wood or some type of thermoplastic that has a texture or gram attractively appealing to the users.

These and other objects and advantages of the present invention will become apparent from the subsequent detailed description of the preferred embodiment and the claims taken in conjunction with the accompanying drawings.

BEST MODE FOR CARRYING OUT THE INVENTION

Figure 1:
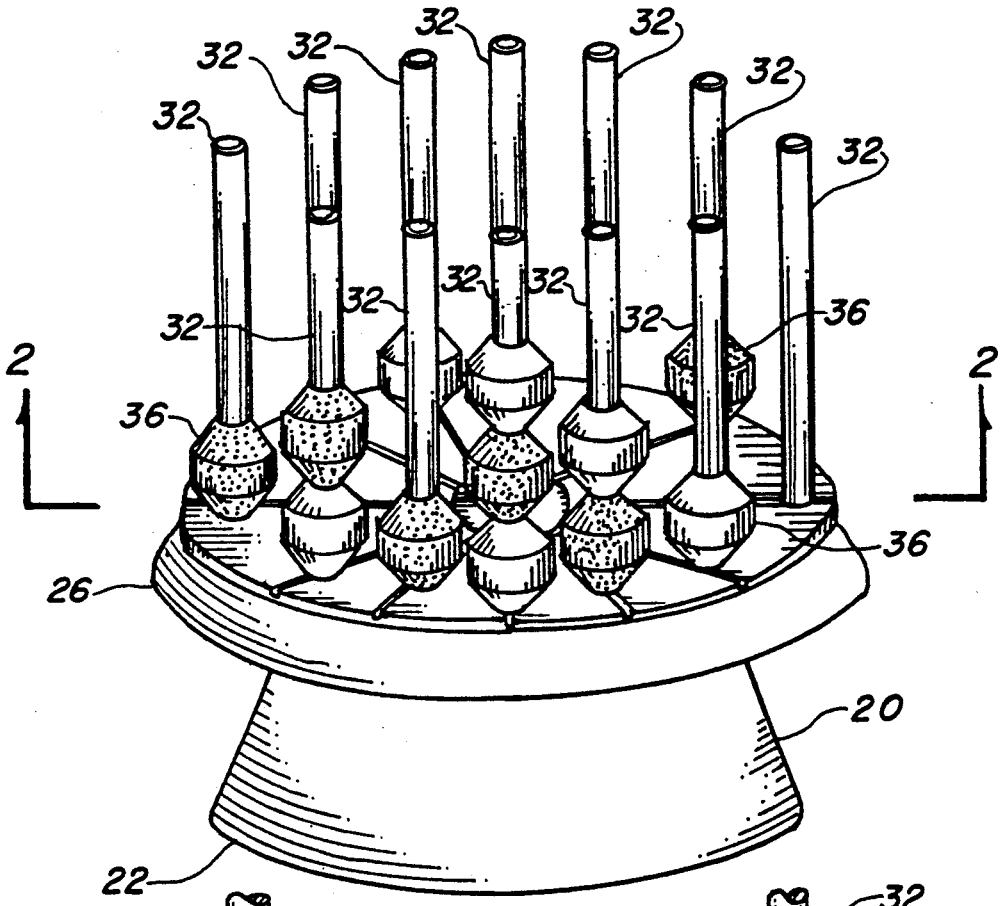
FIG. 1 is a partial isometric view of the preferred embodiment with some of the playing piece hollow beads in place on the pins as during the beginning sequence of play.
Figure 2:
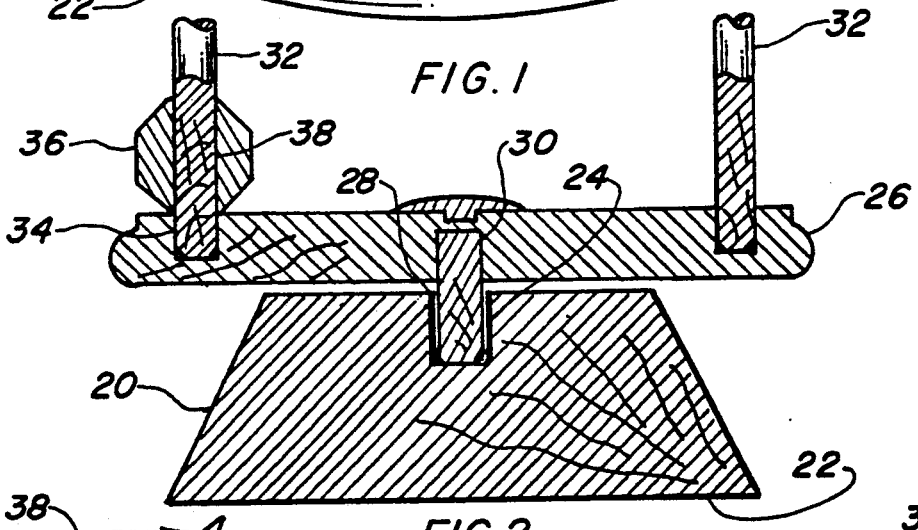
FIG. 2 is a cross-sectional view taken along lines 2—2 of FIG. 1.

The preferred embodiment as shown in FIGS. 1 through 10 is comprised of a structural base 20 having a flat bottom 22 of a size to be stable when sitting on a flat surface such as table or floor. The base 20 has a round socket 24 located in the center of the top surface that penetrates almost through or at least deep enough to form a axial receiving socket.

A round concentric pedestal 26 is disposed over the top of the base 20 and is rotatably received by the base using a round dowel 28 as a swivel pivot. The dowel 28 is pressed into the center of the pedestal 26 using a round cavity 30 much like the socket 24 socket 24 except it is smaller in diameter requiring a force fit to insert the dowel. The protruding length of the dowel 28 is slightly greater than the depth of the socket allowing clearance between the base 20 and the pedestal 26. This union permits free rotation of the pedestal 26 and the close tolerance of the dowel 28 to the socket 24 allows easy manual rotation as well as horizontal stability.

A plurality of upright dowel pins 32 are axially imbedded into the pedestal 26 on the top near the radial periphery. The pins 32 are pressed into holes 34 and bonded into place with adhesive or the like. Any number of pins 32 may be used however, twelve has been found to be optimum for the game in the preferred embodiment. The height of the pins 32 must be at least four times the length of the playing pieces used in the game enabling a stack of four in a row to be achieved during the playing sequence. The pins 32 are preferably spaced an equal distance apart and positioned near the peripheral edge of the pedestal 26 for symmetry and to allow visualization of the playing pieces placed upon thereupon.

Figure 3:
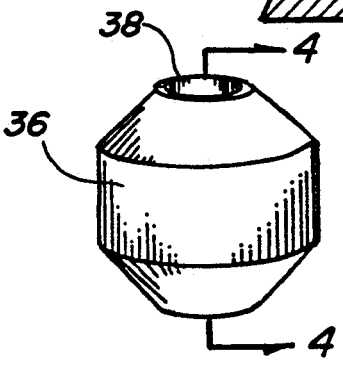
FIG. 3 is a partial isometric view of a hollow bead playing piece by itself.
Figure 4:
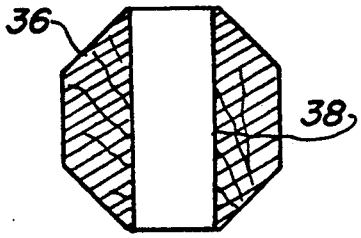
FIG. 4 is a cross-sectional view taken along lines 4—4 of FIG. 3 illustrating the inside construction of the bead.
Figure 5:
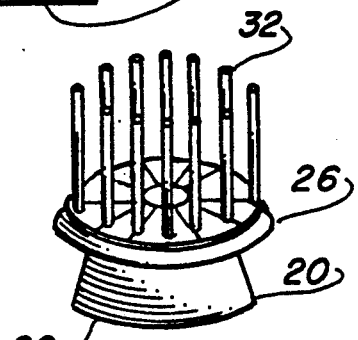
FIG. 5 is a partial isometric view of the preferred embodiment less the playing piece beads.
Figure 6:
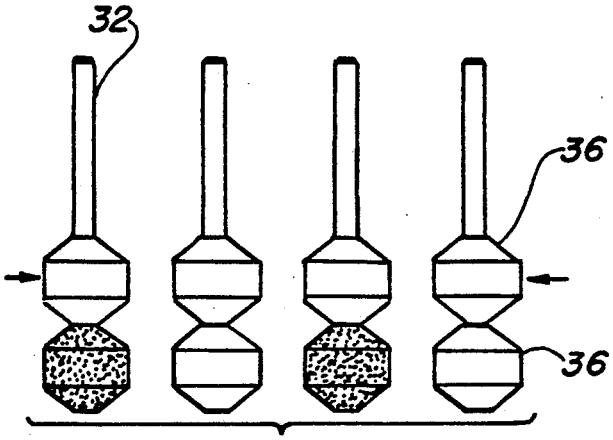
FIG. 6 is a diagram of the beads on the pins aligned in a horizontal position.

The playing pieces are hollow beads 36 preferably a cylindrical shape truncated on each end as depicted by themselves in FIGS. 3 and 4. The shape may vary and still be within the scope of the invention and could include round, oval, cylindrical, cubical and any other basic configuration with a myriad of combinations and contours or forms.

At any rate the hollow beads, or the like, have an opening 38 completely through allowing insertion over the pins 32 in a relatively loose manner. The beads 36 are divided into two categories and have distinguishable markings one for each player. The number of beads 36 each player retains is equal and must be at least enough in total to place four on each pin 32 therefore if twelve pins are employed, forty-eight beads must be available twenty-four on each marking or identification for each player. The marking of the beads 36 may be by color, texture, shape or any other distinguishing feature. Light and dark color is preferred particularly if the pieces are made of wood.

The invention may be constructed in a circular, octagonal or square rotating game pedestal 26. However, the preferred shape is circular as shown in FIG. 1. This "carousel top" design form allows a game to be played that has an unlimited boundary or in other words has no limiting game boundaries, sidelines or barriers. Thus, by the careful selection of game traps, combinations and surprise opportunities winning strategies can be planned and effected.

Figure 9:
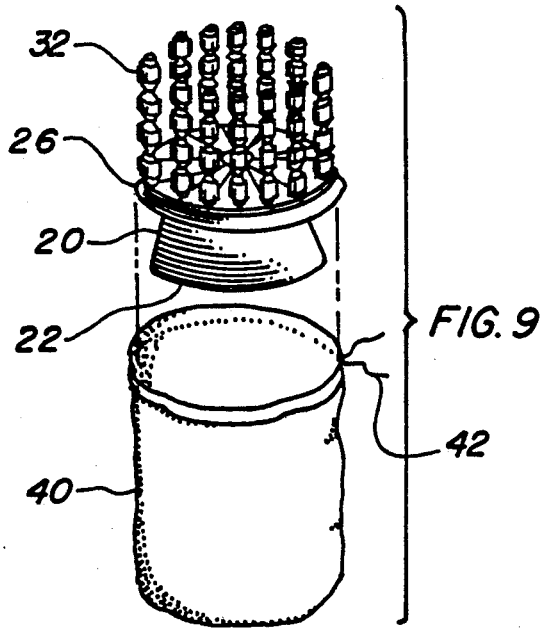
FIG. 9 is an exploded view of the game apparatus removed from the storage bag.
Figure 10:
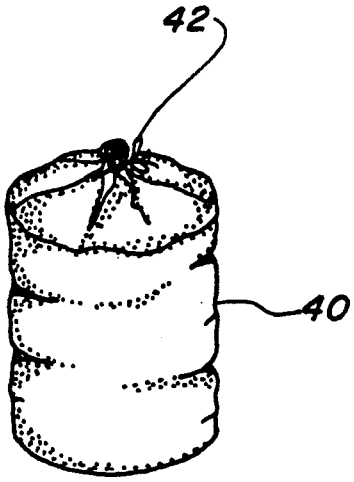
FIG. 10 is a isometric view of the game apparatus stored in a bag with the drawstring closed.

A resilient storage bag 40 as shown in FIGS. 9 and 10 covers and protects the game when not in use. The beads 36 may all be placed on the pins 32 for storage or may be placed loose on top of the pedestal 26 when it is already inserted in the bag. A drawstring closure 42 provides the fastening means to gather the material around the opening and a bow tied in the string provides an openable seal.

Figure 7:
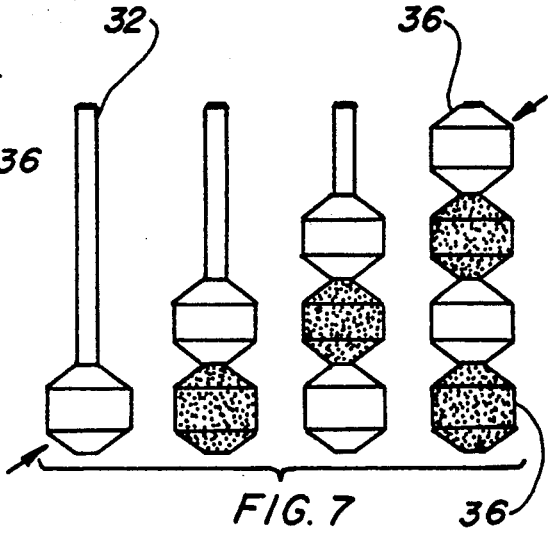
FIG. 7 is a diagram of the beads on the pins aligned in a diagonal position.
Figure 8:
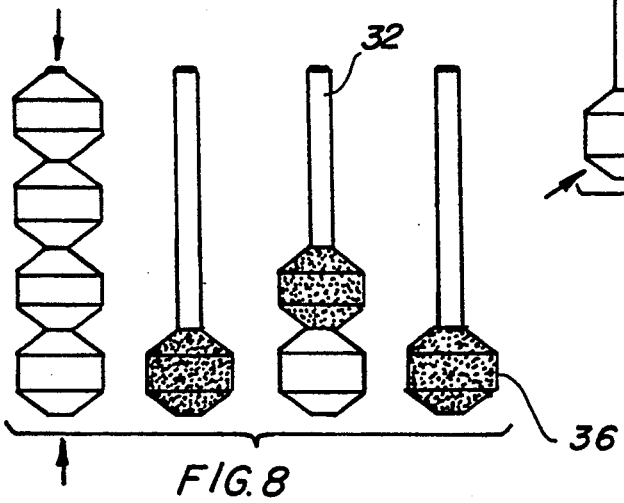
FIG. 8 is a diagram of the beads on the pins aligned in a vertical position.

The game is played by separating the beads 36 into the two markings, one set for each players. The players in turn place one bead 36 on any one of the pins 32 attempting to place their own beads in a distinctive alignment. When twelve pins are used with forty-eight beads, there are three ways to align the beads and win the game: a line (horizontal) alignment as shown enclosed within the arrows in FIG. 6; a ladder (diagonal) alignment as shown in FIG. 7; and a totem (vertical) alignment as shown in FIG. 8.

The rules of the game provide time restraints to limit the time between moves. The rules further state that players alternate placing the beads 36 onto the pins 32, and beads can be placed on any pole that is not already stacked four high. When either a line, ladder or totem is accomplished, the player placing the winning bead must declare and point to the winning play. The game is not over if the winning alignment is not declared. Thus, the game continues until a game winning alignment is noticed or another winning alignment is declared by either player.

The rules further include that comments or advice from spectators if forbidden since these comments/advice can "tip off" the players to an impending disaster. Additionally, the loser of the last game places the first bead in the next game and also has the choice of bead color. The changing of a bead color can disrupt an opponents winning rhythm. In general, a skilled player utilizes a combination of careful defensive moves, skilled counter-moves and planned offensive strategies to win the game.

While the invention has been described in complete detail and pictorially shown in the accompanying drawings, it is not to be limited to such details, since many changes and modification may be made in the invention without departing from the spirit and the scope thereof. Hence, it is described to cover any and all modifications and forms which may come within the language and scope of the claims.

I claim:

1. A competitive strategy game apparatus for two players comprising:

a) a structural base for mounting on a flat surface, b) a concentric pedestal having a top and a bottom rotatably disposed upon the base permitting manual rotation thereof, c) a plurality of upright dowel pins axially affixed to the pedestal top all of said dowel pins located near the pedestals radial peripheral, wherein all of said dowel pins together produce only one peripheral array concentric with the pedestals radial peripheral and said peripheral array having an unlimited boundary form with no side lines or barriers and d) a plurality of hollow beads having two separate and distinguishable markings one for each player in equal numbers, for interposing one on top of the other upon the pins by each player in turn in an attempt to line up their own beads in a horizontal, diagonal or vertical row.

2. The games as recited in claim 1 further comprising said base having a round socket centrally positioned in an uppermost surface, and said pedestal having a round dowel axially descending from the bottom thereof with the dowel disposed within the socket permitting rotation of the pedestal upon the base.

3. The games as recited in claim 1 wherein each pin has at least a length of four times the height of the hollow beads.

4. The games as recited in claim 1 further comprising said plurality of pins are twelve in number.

5. The games as recited in claim 1 wherein said beads further comprise a cylindrical shape truncated on each end.

6. The games as recited in claim 1 further comprising said plurality of beads are forty-eight in number, twenty-four of each marking.

7. The games as recited in claim 1 further comprising a resilient storage bag large enough to retain the base and pedestal with the beads stored on the pins, said bag having a drawstring as a closure.

8. The games as recited in claim 1 wherein said pedestal has a circular shape.

* * * * *